United States Patent [19]

Stewart

[11] Patent Number: 4,971,334

[45] Date of Patent: Nov. 20, 1990

[54] THROW AND CATCH GAME

[76] Inventor: James C. Stewart, 2675 Grove Ave., San Diego, Calif. 92154

[21] Appl. No.: 484,855

[22] Filed: Feb. 26, 1990

[51] Int. Cl.[5] ..... A63B 67/00

[52] U.S. Cl. ..... 273/346; 273/58 A; 273/359; 273/414; 273/428; 273/DIG. 30

[58] Field of Search ..... 273/346, 359, 412, 349, 273/428, 414, DIG. 19, 30, 58 R, 58 A, 58 K

[56] References Cited

U.S. PATENT DOCUMENTS

| | | | |
|---|---|---|---|
| 3,118,675 | 1/1964 | Lyle | 273/428 X |
| 3,370,853 | 2/1968 | Feld et al. | 273/346 |
| 3,479,027 | 11/1969 | Fryer | 273/1 G |
| 4,017,076 | 4/1977 | Bai | 273/346 |
| 4,718,677 | 1/1988 | Barnes | 273/412 |
| 4,743,030 | 5/1988 | Aver et al. | 273/349 |

*Primary Examiner*—William H. Grieb

[57] ABSTRACT

A throw and catch game including a projectile for throwing from a first person to a second person, the projectile including a plurality of contiguous flat surfaces, on which is placed releasable bonding material and a vest-type garment including front and rear panels, containing bonding material thereon for receiving and catching the projectile, the garment further containing scoring indicia proximate to the bonding material for indicating a score dependent upon receipt of the projectile in a particular area thereon, wherein the projectile is of a weight-to-size ratio such that its travel from the first person to the second person is affected by the wind stream flowing over the flat surfaces to vary its trajectory from a normal parabolic path.

10 Claims, 1 Drawing Sheet

THROW AND CATCH GAME

BACKGROUND OF THE INVENTION

1. Field of the Invention

This invention pertains to the field of throw and catch games involving persons of all ages wherein athletic ability is not a requirement but wherein participation will greatly influence personal development and body musculature.

2. Description of the Prior Art

There are numerous games involving the throwing and catching of projectiles, some that are purely sports-oriented and others combining sports orientation with the development of agility and body musculature. Many games require fully developed body musculature and significant skills such as football, basketball and baseball, and are thus open only to the truly athletic and agile person. Others are more general in nature and are open to the athlete and non-athlete alike.

Catch games are attractive to young people because they involve body movement and agility. While young people have the drive to participate for long periods of time in such sports, older people and adults become bored with the repetition of activity. Some games have been developed to involve scores or accumulation of points to rekindle interest and keep such interest from flagging for those who would normally become bored with the repetition. Where scores are involved, the sport becomes one of developing agility, developing bodily musculature and rudimentary practice in addition.

Children's games are often team-oriented. Psychological surveys have demonstrated young people desire group bonding and group activities to meet their social needs because the group's efforts tend to mask the individual shortcomings of the participants. Only after personal athletic skill and substantial bodily musculature is developed comes the desire to act solely in sports such as in tennis, marathon running and other individualized activities.

A significant problem with games of catch has come about with the crowding of persons in neighborhood family developments. The old fashioned neighborhood playground is vanishing from our culture because of land development and crowding due to the increasing American population. School playgrounds are being heavily patrolled and often locked tight after school hours to reduce and/or prevent drug dealing and other crimes from taking place thereon. In addition, the crowding of homes and the rise in real estate costs had caused a reduction in the overall residential lot size so that the size of the traditional backyard is also shrinking.

The typical backyard is now very small and is constantly being filled with shrubbery, flowers, decks and walks as well as barbecue devices as our culture tends to emphasize these features. Accordingly, the child of today is literally running out of room in which to undertake any sports such as a throw and catch game and even then is reduced to playing in a very small backyard or a bedroom.

In the area of catch games utilizing small play areas, the traditional baseball, softball and basketball have given way to a much lighter, less potentially damaging projectile. The "NERF"(Trademark) ball and projectiles like it are lightweight, made of soft foam such that they can be thrown and caught in small areas including the living room or other interior portions of the house while not causing damage to radios, televisions, figurines and other items normally found therein. Specifically, in throw and catch games for small areas, U.S. Pat. No. 4,718,677 shows the use of a round ball of lightweight covered with Velcro (Trademark) for tossing from one person to another to be caught with cuff-like receivers worn on the forearms and the legs. While this is an interesting game, the cuffs, to be wearable, must be sized such that they will be too loose for children if sized for adults and too tight for adults if sized for children. Further, after the ball is thrown, the receiver is required to raise an arm or leg to catch the ball on the Velcro pad or other bonding material attached to the receiver. Such use of forearms and legs invites wild throwing and, in a confined backyard, would tend to invite the projectile to be thrown over the fence into a neighbor's yard, thus prompting neighborhood complaints. In addition, the use of arms and legs brings athleticism back into the picture and will cause the non-athlete to withfraw from further play. Further, since the arm is used as a "shield", one may attempt to catch a ball thrown at one's face with the forearm. If a miss occurs, the projectile may well strike the face or eyes of the receiver causing substantial personal injury. Still further, the game only develops the arms and legs of an individual without developing other portions of the body.

SUMMARY OF THE INVENTION

This invention is an entirely new and advantageous combination throw and catch game possessing all of the desired features not heretofore found in the prior art. The invention involves the use of a very lightweight projectile of a size that is able to fit into the palm of one's hand or easily grasped by the hand and that contains a series of flat surfaces, each of which is covered with a tear-away bonding material such as Velcro. In lieu of the cuff-like receivers of the prior art worn on the extremities, the participants wear a vest-like garment that contains bonding material such as Velcro on the front and back surfaces for positioning adjacent the front and back of the wearer's torso.

The vest is of one size that will fit all sizes of persons from small children to large adults and contains over-the-shoulder straps to allow the chest and back target portions to be draped across the torso and a fastenable belt-like strap at the bottom of the vest for tieing about one's waist. The targets on the chest and back are divided into particular areas, each carrying an indicia of a different numerical score so that by "catching" the ball in a particular area of the chest or the back, one may be able to increase their score to achieve a winning total over other participants.

Since receivers are not worn on the extremities, the arms and legs may be used purely for shielding purposes, thus increasing the overall safety of the game. Further, since the arms and legs are not utilized to develop the score, they may be used to help one turn their body or move their chest and back into or out of the line of trajectory of the ball so that the torso, as well as the arms and legs, are involved in playing the game thus developing musculature over the entire body.

The projectile contains at least one and as many as six flat surfaces in contiguous arrangement each containing a pull-apart bonding material such as Velcro for attaching to the receiving surfaces of the wearer's vest. The specific use of flat surfaces in the projectile provide a variety of benefits to the game. For instance, the utilization of square surfaces in a cuboid configuration allow hands of different sizes to be able to grasp the projectile with more authority, i.e., a small's hand can grasp adjacent flat surfaces and slightly squeeze the projectile thus increasing the positive holding of the projectile during the throwing action. Further, the flat surfaces in combination with the light weight of the projectile inhibit long parabolic trajectories thus reducing the chance for it to be thrown over a fence or out of the arena of play. Still further, the flat surfaces create different wave patterns in the air passing over the projectile thus making the projectile bob and weave throughtout its trajectory and add a substantial amount of uncertainty to the thrower's accuracy thus reducing the extent of athleticism and personal agility required to competently participate in the game. In other words, the specific projectile's shape makes the young, inexperienced participant equally able to achieve a winning score in a competition involving a far more developed and specifically athletic-type person.

Finally, the nature of the game is to throw the projectile at the other person's body as opposed to throwing the projectile away from the body thus requiring the receiver to run or throw themselves or their arms and legs akimbo to receive the projectile. Such, therefore, increases the safety of the game and at the same time, keeps the participation interesting to develop a score that will show achievement to those of a wide variety of age groups.

The main object of this invention, therefore, is to provide a throw and catch game that can utilize participants of all age groups in the common playing of the game, that will eliminate personal skills or at least reduce them to a point in which the youngest and less skilled participant is equally at risk of obtaining a winning score as the more developed and possibly, older, participant.

Other objects include a game that may be played in a highly confined area, including indoor areas where normal games might possibly cause damage to small objects positioned nearby, a game involving accumulation of scores that will retain the interest level of those who would normally become bored with the repetition of throw and catch games, a game requiring the movement of the torso and twisting of the body and other total body movements that will cause overall development of body musculature and a game that is safe and easy to play involving garments that are developed in one size for use that fits all sizes of participants.

These and other objects of the invention will become clear when reading the following description of the preferred embodiment taken together with the drawings attached hereto. The scope of protection sought by the inventor may be gleaned from a fair reading of the claims that conclude this specification.

DESCRIPTION OF THE PREFERRED EMBODIMENT

Figure 1:
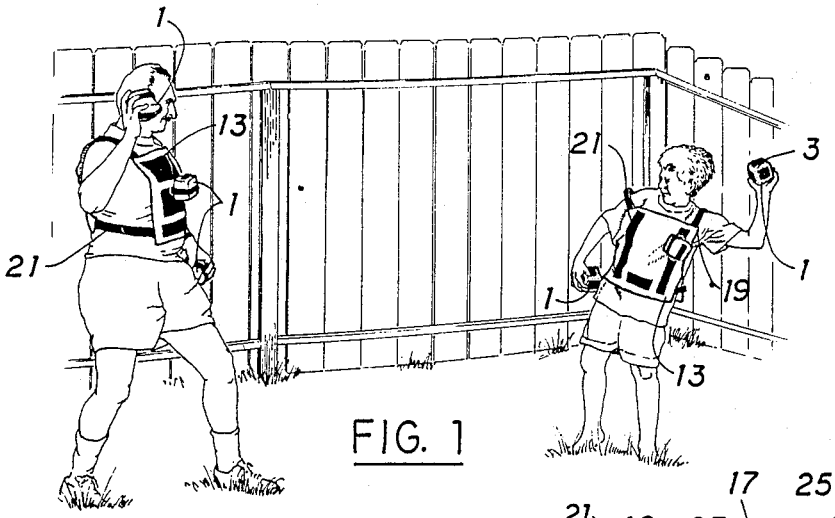
FIG. 1 is an illustrative view of one embodiment of the exercise game of this invention showing both a young and a middle-age person wearing the same vest-type garment and actively engaging in the game itself.
Figure 4:
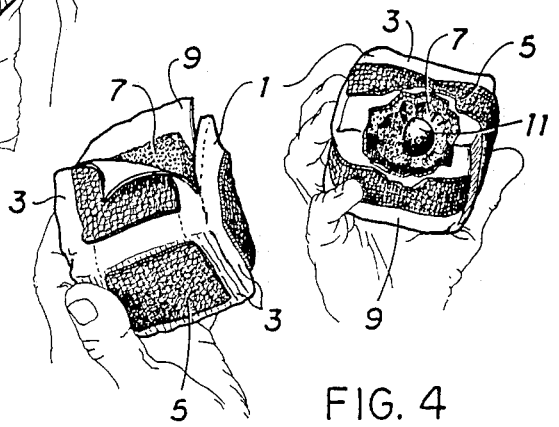
FIG. 4 is an illustrative view of two types of the projectile utilized in this invention.

As shown in FIG. 1, the exercise game of this invention involves a projectile 1 of a configuration containing a plurality of contiguous, substantially flat surfaces 3, such as a cube or cuboid shape, upon which releaseable bonding material 5 is arranged in varying patterns. As shown in FIG. 4, projectile 1 is preferably made of a soft polymeric foam interior 7 of reticulated or non-reticulated foam as polyurethane, polyethylene and polyvinylchloride, over which is placed a covering 9 that can be made from a wide variety of materials such as plastic sheeting, nylon or other such materials and sewn into place along the respective edges thereof. Foam 7 is of such a softness that projectile 1 may be easily squeezed by both large hands and small hands so that it may be handled and thrown with ease by young and old alike, as shown in FIG. 1.

It is important that projectile 1 be of a size and shape and weight that will allow easy throwing, controllable trajectory and handling by persons of all ages and overall safe usage. It has been found that making projectile 1 of a size between about three inches to four inches and preferrably $3\frac{1}{4}$ inches to $3\frac{1}{2}$ inches on a side with a total weight of from about 30 to 40 grams and preferrably 36 grams will satisfy these requirements. The weight of the foam interior 7 and covering 9 usually will not produce a total weight of 36 grams for projectile 1. Accordingly, it has been found desirable to add a hard center 11 as shown in FIG. 4 (cutaway) to achieve the weight. Center 11 may conveniently be a hard plastic or rubber sphere preferrably of about $\frac{3}{4}$ inches in diameter.

Figure 3:
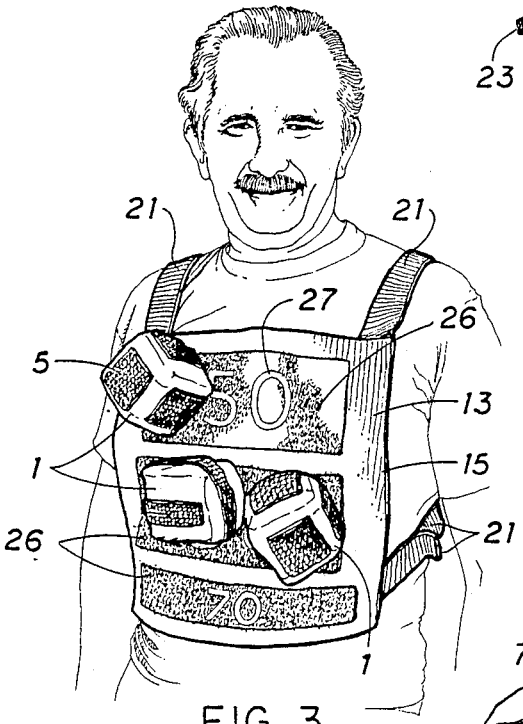
FIG. 3 is a front illustrative view of a wearer showing wearing of the garment and containing some of the projectiles attached thereto.

A vest-type garment 13 is provided which is comprised of two panels 15 of flexible material such as plastic sheeting, nylon, etc., each panel bounded by contiguous sides 17 that form four corners 19 for each panel. Panels 15 are arranged so that they form a vest-type garment as shown in FIG. 3, wherein one panel becomes the chest panel and the other becomes the back panel. The pair of spaced-apart corners 19 at the top of each panel 15 are joined in spaced-apart configuration by a pair of straps 21 that are sewn or otherwise attached at their terminal ends to the uppermost corners so that the panels may be slipped over the head and straps 21 draped across each shoulder respectively as shown in FIGS. 1 and 3.

Figure 2:
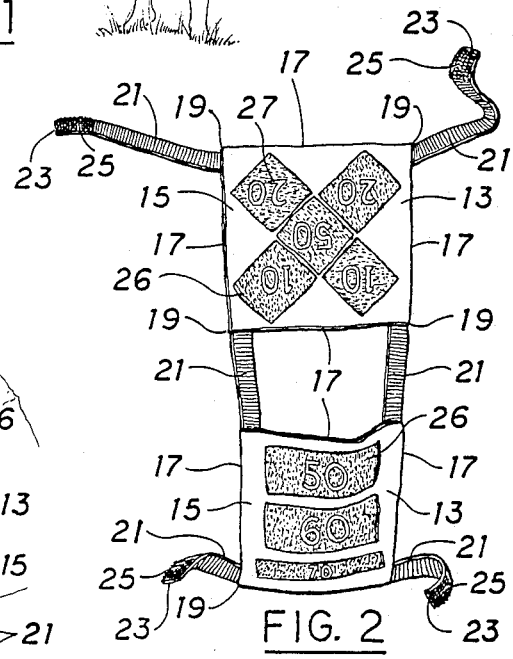
FIG. 2 is a plan view of one embodiment of the vest-type garment of this invention showing the front and back target panels spread apart.

As shown in FIG. 2, the terminal ends 23 of straps 21 are adapted to be joined together about the waist of the wearer. Strap ends 23 preferably contain a short segment 25 of releasable bonding material such as Velcro for overlapped attachment about the waist of both young and older persons of all sizes and shapes.

A plurality of target panels 26 are fixed to panels 13, front and rear, on which are located a series of indicia 27 indicating different scores for striking and attaching projectile 1 to various areas thereof. Said indicia may be made in a variety of numbers with a variety of weights or score factors and may be attached to panels 26 by direct sewing thereto or silk screening or other like attachment processes. In addition, panels 15 may be covered with reflective tape or indicia 27 may be made from strips of reflective tape to better show garments 13 and allow the game to be played in reduced lighting. The same reflective material can be used on sides 17 of projectile 1.

As shown in FIG. 1, throwing projectile 1 between players means that the aim point is the chest and the back of the individual thereby directing the player to not throw the projectile at any area outside of the torso thus allowing the game to be played in a confined area such as a fenced in back yard as shown in FIG. 1. Further, because of the cuboid construction of projectile 1, the flat surfaces cause a change in the air stream passing thereover thus changing the normal parabolic trajectory and allowing the trajectory to change and removing from the activity the nascent skills one might have thereby placing all players on a more or less or equal footing. Even further, a spin imparted to projectile 1 by the thrower will cause it to bob and weave, thus having it depart its normal parabolic path and make the game more interesting . As noted with the trajectory, larger scores may be placed lower on the panels thereby favoring a lower throw and thus away from the face and head thereby reducing the risk of injury to the receiver. Further, with higher scores on the front of the panel and lower scores on the back of the panel, the receiver is inclined to turn their body away from the thrower after the projectile is in the air to catch the projectile on the back of the vest garment thereby reducing the thrower's score. Such a plan tends to favor turning away from the incoming projectile thus providing even a greater margin of safety. To insure the receiver just does not run out of the way, a penalty may be provided for those projectiles that drop to the ground without being caught on the vest. Accordingly, it would be to the benefit of the receiver to continue to turn their back to the thrower and thus reduce the possibility of high score. All of these actions prompt the receiver to twist this way and that in an effort to catch the projectile on a low-scoring area and thus provides an improved exercise for the receiver.

What is claimed is:

1. A throw and catch game comprising:

(a) a projectile for throwing from a first person to a second person, said projectile including a plurality of contiguous flat surfaces, on which is placed releasable bonding material; and, (b) a vest-type garment including front and rear panels, containing bonding material thereon for receiving and catching the projectile;

(c) said garment further containing scoring indicia proximate to said bonding material for indicating a score dependent upon receipt of said projectile in a particular area thereon;

(d) wherein said projectile is of a weight-to-size ratio such that its travel from the first person to the second person is affected by the wind stream flowing over the flat surfaces to vary its trajectory from a normal parabolic path.

2. The throw and catch game of claim wherein said bonding material is Velcro.

3. The throw and catch game of claim 1 wherein said bonding material is centrally located on at least one flat surface of said projectile.

4. The throw and catch game of claim 1 wherein said bonding material is located on all flat surfaces of said projectile.

5. The throw and catch game of claim 1 wherein said bonding material is arranged in various patterns on the frontal chest area and the upper back area of said garment.

6. The throw and catch game of claim 1 wherein said garment comprises a pair of rectangular panels for upright position respectively on the chest area and upper back area of the receiver's torso and held in position by a pair of spaced-apart straps extending from the upper corners of said front panel over the wearer's shoulders to the upper corners of the rear panel and wherein the lower edges of said panels are held fast about the wearer's waist with a strap.

7. The throw and catch game of claim 1 wherein said indicia are arranged in scores varying as to the difficulty of striking a portion thereof with said projectile.

8. The throw and catch game of claim 1 wherein said projectile is a cube having a size ranging from about 3 inches to about 4 inches on a side and having a weight of from about 30 to about 40 grams.

9. The throw and catch game of claim 8 wherein said cube has a size of $3\frac{1}{4}$ inches on a side and a weight of 36 grams.

10. The throw and catch game of claim 9 wherein said cube contains a hard spherical center.

* * * * *